US010202872B2

(12) United States Patent
Aumann et al.

(10) Patent No.: US 10,202,872 B2
(45) Date of Patent: Feb. 12, 2019

(54) METHOD AND DEVICE FOR RAPID OIL HEATING FOR OIL-LUBRICATED EXPANSION MACHINES

(75) Inventors: Richard Aumann, Munich (DE); Andreas Schuster, Tussenhausen (DE); Andreas Sichert, Munich (DE)

(73) Assignee: ORCAN ENERGY AG, Munich (DE)

( * ) Notice: Subject to any disclaimer, the term of this patent is extended or adjusted under 35 U.S.C. 154(b) by 661 days.

(21) Appl. No.: 14/112,860

(22) PCT Filed: Apr. 12, 2012

(86) PCT No.: PCT/EP2012/001597
§ 371 (c)(1),
(2), (4) Date: May 24, 2016

(87) PCT Pub. No.: WO2012/149998
PCT Pub. Date: Nov. 8, 2012

(65) Prior Publication Data

US 2018/0030857 A1 Feb. 1, 2018

(30) Foreign Application Priority Data

May 3, 2011 (EP) ..... 11003615

(51) Int. Cl.
*F01K 25/08* (2006.01)
*F01K 13/02* (2006.01)
(Continued)

(52) U.S. Cl.
CPC ..... *F01K 13/02* (2013.01); *F01C 21/045* (2013.01); *F01K 7/22* (2013.01); *F01K 23/106* (2013.01);
(Continued)

(58) Field of Classification Search
CPC ..... F01K 13/02; F01K 7/22; F01K 23/106; F01K 25/06; F01C 21/045; F01D 25/20; F22B 1/1815
See application file for complete search history.

(56) References Cited

U.S. PATENT DOCUMENTS 3,603,087 A * 9/1971 Burkland ..... F01D 25/22 184/6
3,797,249 A * 3/1974 Pezaris ..... F01D 19/00 122/406.1
(Continued)

FOREIGN PATENT DOCUMENTS

DE 102007008609 A1 8/2008
WO 2006131759 A2 12/2006
WO 201017981 A2 2/2010

*Primary Examiner* — Jesse Bogue
(74) *Attorney, Agent, or Firm* — Moore & Van Allen PLLC; Henry B. Ward, III

(57) ABSTRACT

The present invention relates to a method for lubricant heating during starting up of a thermodynamic cycle device, wherein the cycle device comprises a working medium with a working substance and a lubricant, an evaporator for evaporating the working substance, a lubricant separator for separating at least part of the lubricant from the working medium which is supplied by the evaporator, an expansion machine which is to be lubricated with the lubricant, and a condenser device with a condenser, and wherein the method comprises the following steps: delivery of lubricant from the lubricant separator to the condenser device and/or to the evaporator during shutdown of the cycle device, as a result of which a working medium which is enriched with lubricant is provided in the condenser device and/or in the evaporator; and heating of the working medium which is enriched with lubricant in the evaporator during starting up of the cycle device. Furthermore, the invention relates to a thermodynamic cycle device which comprises means for
(Continued)

delivering lubricant from the lubricant separator to the condenser device and/or to the evaporator during shutdown of the cycle device, as a result of which a working medium which is enriched with lubricant can be provided in the condenser device and/or in the evaporator.

20 Claims, 4 Drawing Sheets

(51) Int. Cl.

| | |
|---|---|
| ***F01K 25/06*** | (2006.01) |
| ***F01C 21/04*** | (2006.01) |
| ***F01K 7/22*** | (2006.01) |
| ***F01K 23/10*** | (2006.01) |
| *F01D 25/20* | (2006.01) |
| *F22B 1/18* | (2006.01) |

(52) U.S. Cl.
CPC ..... *F01K 25/06* (2013.01); *F01D 25/20* (2013.01); *F22B 1/1815* (2013.01)

(56) References Cited

U.S. PATENT DOCUMENTS

| | | | | |
|---|---|---|---|---|
| 5,245,820 | A * | 9/1993 | Zalewski | F01D 25/18 60/39.08 |
| 6,948,316 | B2 * | 9/2005 | Minemi | F01B 3/02 60/670 |
| 8,215,114 | B2 * | 7/2012 | Smith | F01C 1/16 60/651 |
| 9,732,616 | B2 * | 8/2017 | Schuster | F01K 25/10 |
| 2007/0245732 | A1 * | 10/2007 | Uno | B60H 1/3214 60/649 |
| 2011/0265476 | A1 * | 11/2011 | Berger | F01K 13/02 60/651 |
| 2016/0169055 | A1 * | 6/2016 | Grill | F01K 17/04 60/645 |
| 2016/0290172 | A1 * | 10/2016 | Aumann | F01C 21/04 |

* cited by examiner

METHOD AND DEVICE FOR RAPID OIL HEATING FOR OIL-LUBRICATED EXPANSION MACHINES

FIELD OF THE INVENTION

The present invention relates to a method and a device for the rapid heating of oil for volumetrically working expansion machines in a thermodynamic cycle.

BACKGROUND OF THE INVENTION

The operation of expansion machines, e.g. steam turbines, and for instance with the aid of the Organic Rankine Cycle (ORC) method for the generation of electric energy using organic media. e.g. organic media having a low evaporation temperature which usually have higher evaporation pressures at same temperatures as compared with water as working medium, is known in the state of the art. ORC plants represent a realization of the Clausius Rankine Cycle in which electric energy is generated, for instance, basically through adiabatic and isobaric changes of state of a working medium. Mechanical energy is generated by the evaporation, expansion and subsequent condensation of the working medium, and is converted into electric energy. Basically, the working medium is brought to an operating pressure by a feed pump, and energy in the form of heat, which is provided by a combustion or a flow of waste heat, is supplied to the working medium in an evaporator. The working medium flows from the evaporator through a pressure pipe to an expansion machine where it is expanded to a lower pressure. Subsequently, the expanded working medium steam flows through a condenser in which a heat exchange takes place between the vaporous working medium and a cooling medium. Then, the condensed working medium is recirculated by a feed pump to the evaporator in a cycle.

One particular class of expansion machines is represented by volumetrically working expansion machines, which are also referred to as displacement expansion machines, which comprise a working chamber and which work during a volume increase of this working chamber as the working medium expands. These expansion machines are realized, for instance, in the form of piston expansion machines, screw expansion machines or scroll expanders. Volumetrically working expansion machines of this type are used in particular in low performance class ORC systems (e.g. electrical power of 1 to 500 kW). As opposed to turbines, however, volumetrically working expansion machines require lubrication by means of a lubricant, in particular of the piston and the profiles of the expansion chamber rolling upon one another, and of the rolling bearings and the gliding walls of the working chamber. Hence, it is necessary to lubricate the bearing surfaces and the contacting flanks. The use of a lubricant advantageously also leads to a sealing of the working chamber of the expansion machine, so that less steam is lost by an overflow inside the expansion machine and the efficiency is increased. A lubrication with oil is advantageous, with oil and live steam passing the expansion machine at the same time, which necessitates a subsequent separation of the oil and the steam.

A method and a device for the lubrication of volumetrically working expansion machines are described in the European patent application No. 11000329.0, which represents internal state of the art by the applicant of the present invention.

This lubricating system is schematically shown in FIG. 1. It comprises in one example a lubricant separator (e.g. an oil separator) 10 which is connected between an evaporator 20 that supplies a completely or partially evaporated working medium and an expansion machine 30 that cooperates with a generator 40 and serves in the generation of electric energy. In this design, at least a portion of the lubricant is separated from the live steam of the working substance mixed with the lubricant which is supplied to the expansion machine 30. In the oil separator 10 corresponding separating sheets may be provided such that the working medium arriving at the expansion machine 30 still contains a sufficient quantity of lubricant (lubricating oil), so that it is possible to achieve a reliable lubrication of parts of the working chamber of the volumetrically working expansion machine 30 that roll upon or glide along one another. Alternatively, the separation of the lubricant could be accomplished in the oil separator 10 substantially completely, and an adequate amount of lubricant could be recirculated into the live steam of the working medium before entering the expansion machine 30. The separated lubricating oil is collected in the oil separator 10. As it was brought to a high temperature after passing through the evaporator together with the working medium it is under a high pressure in the oil separator 10, allowing it to flow freely through a corresponding conduit to the expansion machine 30 so as to lubricate there corresponding lubricating points of same. For instance, the lubricant is provided in the working medium in a dissolved form when it is supplied by the feed pump 50 to the evaporator 20. In general, the boiling temperature of the lubricating oil will be clearly higher than that of the working medium, so that after passing through the evaporator 20 it will be present in the working steam of the working medium in a liquid form, viz. droplet form. As, according to the example described, the lubricating oil separated in the oil separator 10 is under a high pressure, allowing it to flow freely to the expansion machine 30 on account of the pressure, it is not necessary to provide another pumping device for the lubricant. Moreover, as compared with the previous state of the art, a smaller steam volume flows through the oil separator 10 per unit time so that same can be designed in a comparatively compact manner, resulting in the saving of space and a reduction of costs. In addition, the pressure loss is reduced downstream of the expansion machine 30 so that the pressure difference can be increased by means of the expansion machine 30, as compared with the conventional configuration comprising an oil separator 10 downstream of the expansion machine 30, thus allowing an efficiency increase of the expansion machine 30. Also, lubricant remains directly in the live steam of the working medium or is supplied to same at live steam temperature, respectively, so that in contrast to the previous state of the art the use of a lubricant does not result in a reduction of the live steam temperature and enthalpy.

In the operation of such a thermodynamic cycle it has shown, however, that the starting (start-up) is very difficult if the oil separator and the oil are cold. The operating temperature of the oil differs significantly from the downtime temperature. In operation, the oil has a temperature that is equal to the live steam temperature of approximately 100° C. However, during downtimes the oil temperature can go down to the ambient temperature, e.g. 10° C. to 25° C., or even down to minus centigrades. As the viscosity of the oil rises at such low temperatures by several orders of magnitude the start-up procedure of the cycle device is problematic. Although an electric heater could overcome this problem, additional investment costs and operating costs would be necessary. In addition, an electrical heating of the oil would take too long. Consequently, it is the object of the present invention to provide a method and a device for the rapid heating of the oil after a downtime of the cycle device described.

BRIEF SUMMARY OF THE INVENTION

The aforementioned object is solved by a method for lubricant heating upon starting up a thermodynamic cycle device, wherein the cycle device comprises a working medium including a working substance and a lubricant, an evaporator for evaporating the working substance, a lubricant separator for separating at least a portion of the lubricant from the working medium supplied from the evaporator, an expansion machine to be lubricated with the lubricant, and a condenser apparatus having a condenser, and wherein the method comprises the steps of: supplying lubricant from the lubricant separator to the condenser apparatus and/or to the evaporator upon shutting down the cycle device so as to provide a working medium enriched with the lubricant in the condenser apparatus and/or in the evaporator; and heating the working medium enriched with the lubricant in the evaporator upon starting up the cycle device.

When closing down, respectively shutting down the cycle device lubricant is transported from the lubricant separator to the condenser and/or to the evaporator. In this way lubricant will be available at the start of (upon starting up) the cycle device for heating in the evaporator. At the shut-down time of the system (cycle device) both the condenser and the evaporator contain working substance which is still liquid, in which the lubricant, e.g. oil, can dissolve. If the system is restarted, the strongly lubricant-containing working medium is already located in the evaporator, or is transported from the condenser to and into the evaporator. Due to the dissolution in the low-viscosity working substance, the viscosity of the working medium containing the working substance and the lubricant is reduced as compared with the viscosity of the separate lubricant. The heat supply takes place in the evaporator, the cold working medium is heated, and the working substance is evaporated entirely or in part whilst the lubricant remains liquid and is separated in the lubricant separator.

A further development of the method according to the invention consists in that the supplying of lubricant from the lubricant separator upon shutting down the cycle device may include a reduction of the pressure in the lubricant separator. In particular, the pressure in the lubricant separator may be reduced by 10% to 95%, preferably by 20% to 95%, even more preferably by 50% to 95%, for instance within a period of 1 to 1000 milliseconds, preferably within a period of 1 to 500 milliseconds, even more preferably within a period of 1 to 100 milliseconds. The working substance dissolved in the lubricant evaporates as the pressure is reduced. This process effects a frothing up of the working substance.

In order to transport the lubricant from the lubricant separator into the condenser and/or evaporator when the system is stopped (shut down) the pressure in the lubricant separator is, according to this further development, reduced rapidly. This is preferably realized during a time span of 1 to 1000 milliseconds and by 10% to 95% of the pressure present at the beginning of the reduction in the lubricant separator. This means that, for instance within 0.1 seconds, an initially present pressure is reduced from 3 bar to 1.2-2 bar (condenser pressure), i.e. by about 33-60%. This rapid pressure drop results in the evaporation of the working substance dissolved in the lubricant. During this process the lubricant is frothed up and can then move, for instance through connecting conduits, to the condenser and/or evaporator. A pressure drop could be realized, for instance, by withdrawing a piston from the lubricant separator. Another possibility is that the expansion machine continues to rotate, either by itself on account of the available angular momentum, or driven by an engine.

According to another further development the reduction of the pressure in the lubricant separator may be realized after a standstill of the expansion machine. Thus, it is possible to still exploit the work performed by the expansion machine.

A further development of the method according to the invention consists in that the cycle device may further comprise a bypass line between the lubricant separator and the condenser apparatus so as to bypass the expansion machine, and in that the bypass line can be opened and closed by means of a valve, in particular a solenoid valve, and wherein the step of supplying lubricant from the lubricant separator to the condenser apparatus may include the opening of the valve. According to this further development the frothing up of the lubricant may be accomplished by opening the valve, which closes a conduit between the lubricant separator and the condenser in the working condition of the system, thus realizing a rapid pressure drop in the lubricant separator.

According to another further development the method may include the further step of stopping a supply of working medium to the evaporator upon shutting down the cycle device prior to the supply of lubricant from the lubricant separator to the condenser apparatus and/or evaporator. Thus, the residual heat in the evaporator still allows the production of steam and the expansion thereof in the expansion machine before lubricant is passed from the separator to the condenser and/or evaporator to remain there respectively for instance, without carrying the lubricant conducted to the evaporator off again with the steam, entirely or in part, on account of the residual heat.

Another further development of the method according to the invention consists in that the condenser apparatus may further comprise a feed container in which condensed working substance is collected, and wherein the cycle device may further comprise a feed pump; and wherein the step of supplying lubricant from the lubricant separator to the condenser apparatus upon shutting down the cycle device may comprise a supplying of lubricant from the lubricant separator to the feed container; and wherein the step of heating the working substance enriched with lubricant in the evaporator upon starting up the cycle device may comprise a pumping of working medium enriched with the lubricant from the feed container to the evaporator by means of the feed pump. According to this further development lubricant is collected in the feed container upon shutting down the system, and is transported by the feed pump from the feed container directly to the evaporator when the system is started, so that a greater quantity of lubricant can be heated during the start-up.

In this further development in particular the step of supplying lubricant from the lubricant separator to the condenser apparatus may consist merely of a supplying of lubricant from the lubricant separator to the feed container of the condenser apparatus, meaning without the supply of lubricant to the condenser of the condenser apparatus. The bypass line between the lubricant separator and the condenser apparatus is, in this case, a conduit between the lubricant separator and the feed container, instead of a conduit between the lubricant separator and the condenser. However, the conduit between the lubricant separator and the condenser apparatus may comprise both a conduit to the condenser and a conduit to the feed container.

In the latter case, the step of supplying lubricant from the lubricant separator to the condenser apparatus comprises a supplying of lubricant from the lubricant separator to both the condenser and the feed container.

According to another further development the method may comprise the following additional steps: conducting evaporated working substance to the condenser, e.g. through the bypass line, upon starting up the cycle device; detecting a filling level of lubricant in the lubricant separator, and conducting the evaporated working substance to the expansion machine upon detecting a predetermined filling level, e.g. by closing the valve of the bypass line.

A further development of the last-mentioned further development may comprise the step of opening a valve, in particular a solenoid valve, in a lubricant conduit from the lubricant separator to the expansion machine upon starting up the cycle device. During the start-up the initially closed valve in the lubricant conduit prevents that cold lubricant is transported to the expansion machine. Upon a sufficient filling level of heated lubricant in the lubricant separator this valve in the lubricant conduit may be opened and the valve in the bypass line may be closed.

The aforementioned object is further solved by a thermodynamic cycle device comprising: a working medium including a working substance and a lubricant; an evaporator for evaporating the working substance; a lubricant separator for separating at least a portion of the lubricant from the working medium supplied from the evaporator; an expansion machine to be lubricated with the lubricant; a condenser apparatus having a condenser; and means for supplying lubricant from the lubricant separator to the condenser apparatus and/or to the evaporator when the cycle device is shut down, so that a working medium enriched the with lubricant can be provided in the condenser apparatus and/or in the evaporator.

The advantages of the apparatus according to the invention and the further developments thereof described below correspond to those that were described in connection with the method according to the invention.

According to a further development the means for supplying lubricant from the lubricant separator to the condenser apparatus may comprise a bypass line provided with a valve, in particular a solenoid valve, between the lubricant separator and the condenser apparatus for bypassing the expansion machine, and/or the means for supplying lubricant from the lubricant separator to the evaporator may comprise a lubricant conduit between the evaporator and the lubricant separator.

According to another further development the condenser apparatus may further comprise a feed container in which condensed working substance and lubricant from the lubricant separator can be collected, and wherein the cycle device may further comprise a feed pump for pumping working medium enriched with the lubricant from the feed container to the evaporator.

According to another further development, means for detecting a filling level of lubricant in the lubricant separator may be provided.

Another further development consists in that a lubricant conduit comprising a valve, in particular a solenoid valve, may be provided between the lubricant separator and the expansion machine, wherein the lubricant separated in the lubricant separator may be conducted in the lubricant conduit to lubricating points of the expansion machine, in particular to a bearing of the expansion machine.

Another further development consists in that the cycle device may be an Organic Rankine Cycle device and/or in which the expansion machine may be selected from the group consisting of a piston expansion machine, screw expansion machine, a scroll expander, a vane-type machine and a Roots expander.

A steam power plant according to the invention comprises a cycle device according to the invention or at least one of the further developments thereof.

Additional features and exemplary embodiments, as well as advantages of the present invention will be explained in more detail below by means of the drawings. It will be appreciated that the scope of the present invention is not limited to the embodiments. It will further be appreciated that some or all of the features described below may also be combined with each other in another way.

DETAILED DESCRIPTION OF THE INVENTION

Figure 1:
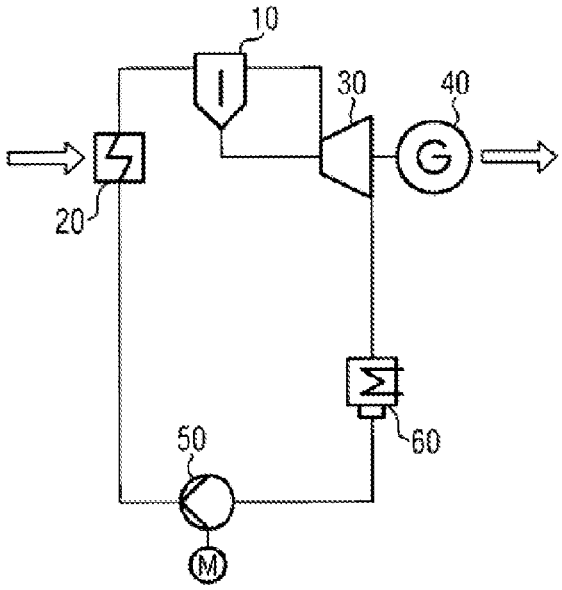
FIG. 1 illustrates a lubricating system for a volumetric expansion machine according to an internal state of the art known to the applicant.
Figure 2:
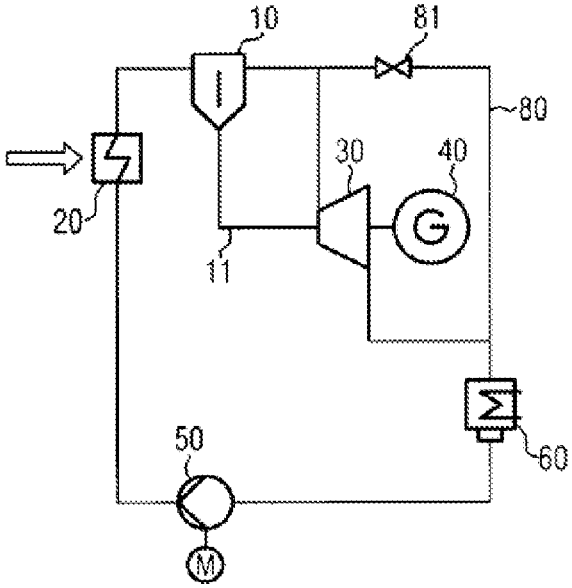
FIG. 2 illustrates by way of example a first embodiment of the thermodynamic cycle device according to the present invention.

As shown in FIG. 2 a first embodiment of the cycle device according to the invention (corresponding to the cycle device according to the internal state of the art as shown in FIG. 1) comprises an evaporator 20, an oil separator 10, an expansion machine 30, a generator 40, a condenser 60 and a feed pump 50, as well as an oil conduit 11 between the oil separator 10 and the expander 30. In particular, oil for the lubrication of bearings in the expander is conducted through this conduit 11. However, the first embodiment according to the invention additionally also comprises a bypass line 80 between the oil separator 10 and the condenser 60, wherein the bypass line 80 is closed and opened by a valve 81.

Figure 3:
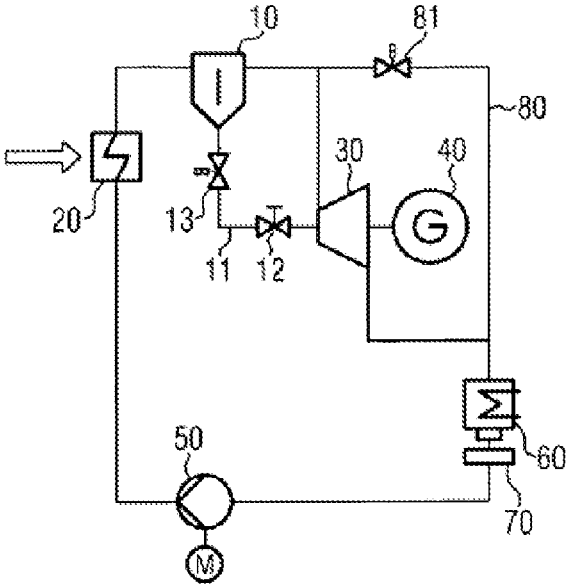
FIG. 3 illustrates by way of example a second embodiment of the thermodynamic cycle device according to the present invention.
Figure 4:
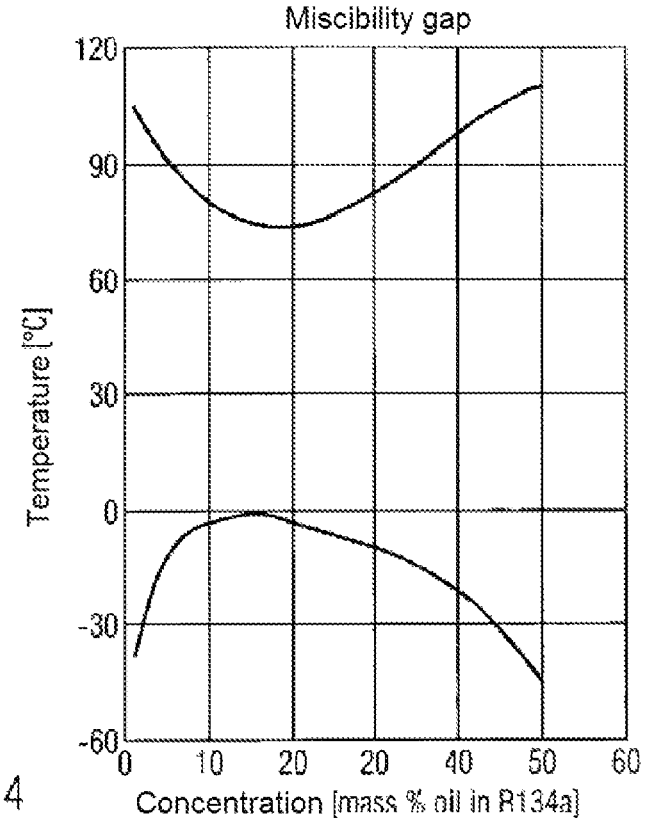
FIG. 4 illustrates by way of example a miscibility gap for a working substance and a lubricant.
Figure 5:
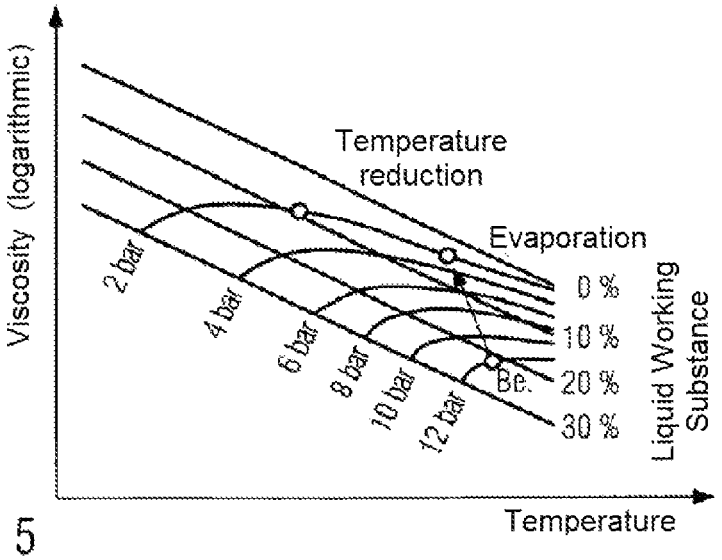
FIG. 5 illustrates by way of example the viscosity and the percentage of working substance dissolved in the oil depending on the temperature.

FIG. 3 illustrates a second embodiment of the cycle device according to the invention, which corresponds to the first embodiment and where identical reference numbers designate components that correspond to one another. In this second embodiment a feed container 70 is additionally provided in which condensed working medium from the condenser is collected. The working medium is then sucked by the feed pump 50 from the feed container and transported to the evaporator 20. The valve 81 is furthermore designed as a solenoid valve 81. In addition, a throttle valve 12 in the oil conduit 11 as well as a solenoid valve 13 are provided.

The following description shall apply correspondingly to both embodiments according to FIG. 2 and FIG. 3.

The diameter chosen for the oil conduit 11 and the throttle valve 12 permits the non-recurrent adjustment of the necessary oil volume flow to be supplied to the bearings. The oil separator 10 itself is constructed such that sufficient oil is supplied with the live steam to the flanks (movable contact points of the working chamber in the expansion machine). In operation it shows that the start-up is very difficult if the oil separator 10 and the oil are cold. The operating temperature of the oil differs significantly from the downtime temperature. In operation the oil has a temperature equal to the live steam temperature of approximately 100° C., while the temperature in downtimes can fall even to minus degrees. As the viscosity increases by several orders of magnitude at low temperatures the start-up turns out to be problematic: the oil no longer passes the throttle valve 12 to a desirable extent.

The method according to the invention solves the problem regarding the heating of oil after downtimes and cooling down in a novel and advantageous manner. After the system was shut down the oil is transported out of the oil separator 10 and in the direction of the condenser 60 and/or the evaporator 20. At the shut-down time of the system working medium still in a liquid state, in which the oil can be dissolved, is still located in both the condenser 60 and the evaporator 20. If the system is restarted, the strongly oil-containing working medium is already located in the evaporator 20 or is transported by the feed pump 50 into the evaporator 20. Due to the dissolution in the working substance having an extremely low viscosity the viscosity of the oil is reduced to an acceptable extent. The heat supply is realized in the evaporator 20, the cold working medium is heated, and evaporated entirely or in part, with the oil remaining liquid and being separated in the oil separator 10.

For moving the oil from the oil separator 10 into the evaporator 20 and/or condenser 60 when the system is shut down a procedural process is applied. If the pressure is reduced abruptly after shutting down the system, i.e. after the standstill of the expansion machine 30, the working substance dissolved in the oil evaporates. This process takes place very fast, and the oil is frothed up intensively at the same time. The process may be compared with the frothing of a shaken mineral water bottle. If the opening and, thus, the pressure reduction takes place slowly enough no foam will develop and the water remains in the bottle. If the opening takes place abruptly, however, the gas is liberated rapidly and carries a portion of the water with it out of the bottle. In the present case, the liberated working substance correspondingly carries with it a portion of the oil out of the oil separator 10.

The rapid pressure drop may be realized by opening the bypass line 80 by means of valve/solenoid valve 81, which bypasses the expansion machine 30 and connects the live steam conduit leading from the oil separator 10 to the expansion machine 30 to the condenser 60.

If an automatic control or the user now decides that the system should be shut down, the supply of working medium into the evaporator 10 is stopped, while steam is still being generated by the residual heat and expands in the expansion machine 30. Above a specific pressure ratio the expansion machine 30 stops the mechanical work. With R245fa as working medium and a condensation at ambient temperature this is approximately a pressure ratio of 2, which corresponds to a pressure of about 3 bar. Starting at this point in time the solenoid valve 81 in the bypass line 80 can be opened, followed by the rapid pressure drop as described above, accompanied by the frothing of the oil. Depending on the position of the conduits one portion of the oil flows to the evaporator 20, while the major portion of the oil flows to the condenser 60 and the feed container 70. To shut down the system oil and working substance are now present in the evaporator 20 and the condenser 60/feed container 70 in a dissolved form, while the oil-carrying conduit 11 and the oil separator 10 contain now only oil residues.

When the system is started the control automatically detects available heat and puts the feed pump 50 into operation, which may alternatively also be forced by the user. Working medium is now transported to the evaporator 20. If a sufficiently large volume flow of steam is generated, this steam entrains the oil in a spray form which is then separated in the oil separator 10. In this operating condition the live steam is passed through the bypass valve 81 directly to the condenser 60 where the steam and the developing condensate flush oil present there in the direction of the feed container 70/feed pump 50.

If a filling level monitoring device (not shown in the illustration) in the oil separator 10 detects a sufficiently high oil filling level the solenoid valve 13 in the oil conduit 11 is opened and the solenoid valve 81 in the bypass line 80 is closed. Pressure is now continuously built up. At the same time, the control adjusts the feed pump speed and the expansion machine speed in response to the available heat flow. A change to the throttle valve 12 in operation need not take place; it serves in the non-recurrent adjustment of the volume flow, and could also be replaced by a fixed throttle.

In the constructive implementation the working media used in an ORC system (thermodynamic cycle device based on the Organic Rankine Cycle) are normally hydrocarbons fluorinated in part or entirely (CFCs) (e.g. R134a, R245fa etc.). It is now necessary to find a lubricant which has good dissolving properties with respect to the CFCs in the cold state. To this end, oils from the synthetic ester group are suitable. Oils from the Reniso Triton SE/SEZ series by Fuchs may be cited here as product examples. As opposed to conventional refrigerant oils same are very well miscible with polar CFCs. No miscibility gap must occur in the range of the condensate temperatures (usually 0 to 60° C.) (see illustration 4, Fuchs Europe Schmierstoffe (Ed.): *Product information RENISO TRITON SE* 55. *Mannheim:* 2010). As a rule, temperature-independent miscibility gaps are observed with conventional refrigerant oils, with a phase separation undesirable for the method described taking place within certain concentration boundaries for each temperature.

In order to allow for the realization of the above-described effect of the oil discharge by means of frothing up, a sufficient amount of working medium has to be dissolved in the oil at a high pressure, while only little oil must be dissolved in the working medium at reduced pressure.

Illustration 5 (Fuchs. op. cit.) shows the dependency of viscosity and dissolved working substance on temperature and pressure. At higher pressures and a constant temperature more lubricant is dissolved in the working substance. At a constant pressure, with a rising temperature, the solubility of working substance in the oil is reduced. During the operation of the plant a certain amount of working substance is dissolved in the oil at a high pressure and a high temperature. After opening the bypass valve 81 in the shut-down process the pressure is reduced, a portion of the working medium evaporates leading to a temperature reduction. After the pressure drop some of the refrigerant is dissolved again in the residual amount of oil still present in the oil separator 10. This does not result in an increase of the viscosity, however. The isolines drawn in illustration 5 for concentrations and pressures as well as operating points should be regarded as exemplary.

Summarizing, the separation of oil from the high-pressure steam is advantageous as compared with the oil separation from the low-temperature steam, but especially the start-up of the cold oil cycle constitutes a problem. The method according to the invention permits the oil separator to be emptied when the ORC is stopped. The oil is discharged from the oil separator utilizing a solubility difference associated with a rapid pressure reduction. The oil flows to the condenser, respectively feed container. After having passed the evaporator it is separated in the oil separator as heated liquid oil and is available again to the lubricating circuit. A monitoring of the filling level of the oil separator permits a start-up of the machine after sufficient oil was separated.

The invention claimed is:

1. Method for lubricating a thermodynamic cycle device, wherein the cycle device comprises a working medium including a working substance and a lubricant, an evaporator for evaporating the working substance, a lubricant separator for separating at least a portion of the lubricant from the working medium supplied from the evaporator, an expansion machine to be lubricated with the lubricant, and a condenser apparatus having a condenser, and wherein the method comprises the steps of:

supplying lubricant from the lubricant separator to the condenser apparatus and/or to the evaporator upon shutting down the cycle device so as to provide a working medium enriched with the lubricant in the condenser apparatus and/or in the evaporator, wherein supplying lubricant from the lubricant separator upon shutting down the cycle device includes a rapid reduction of pressure in the lubricant separator resulting in evaporation of the working substance dissolved in the lubricant and a frothing up of the lubricant, thereby moving lubricant from the lubricant separator to the condenser apparatus and/or the evaporator; and heating the working medium enriched with the lubricant in the evaporator upon starting up the cycle device.

2. The method according to claim 1, wherein the supplying of lubricant from the lubricant separator upon shutting down the cycle device includes a reduction of the pressure in the lubricant separator.

3. The method according to claim 2, wherein the reduction of the pressure in the lubricant separator is realized after a standstill of the expansion machine.

4. The method according to claim 1, wherein the cycle device further comprises a bypass line between the lubricant separator and the condenser apparatus so as to bypass the expansion machine, and wherein the bypass line is opened and closed by means of a first valve and wherein a step of supplying lubricant from the lubricant separator to the condenser apparatus includes the opening of the first valve.

5. The method according to claim 4, wherein the first valve is a solenoid valve.

6. The method according to claim 1, comprising the further step of:

stopping a supply of working medium to the evaporator upon shutting down the cycle device prior to the supply of lubricant from the lubricant separator to the condenser apparatus and/or the evaporator.

7. The method according to claim 1, wherein the condenser apparatus further comprises a feed container in which condensed working substance is collected, and wherein the cycle device further comprises a feed pump; and wherein a step of supplying lubricant from the lubricant separator to the condenser apparatus upon shutting down the cycle device comprises a supplying of lubricant from the lubricant separator to the feed container; and wherein the step of heating the working substance enriched with the lubricant in the evaporator upon starting up the cycle device comprises a pumping of working medium enriched with the lubricant from the feed container to the evaporator by means of the feed pump.

8. The method according to claim 4, comprising the further steps of:

conducting evaporated working substance to the condenser, through the bypass line, upon starting up the cycle device;

detecting a filling level of lubricant in the lubricant separator; and conducting the evaporated working substance to the expansion machine upon detecting a predetermined filling level, by closing the first valve of the bypass line.

9. The method according to claim 8, comprising the additional step of:

opening a second valve in a lubricant conduit from the lubricant separator to the expansion machine.

10. The method according to claim 9, wherein the second valve is a solenoid valve.

11. Thermodynamic cycle device comprising:

a working medium including a working substance and a lubricant;

an evaporator for evaporating the working substance;

a lubricant separator for separating at least a portion of the lubricant from the working medium supplied from the evaporator;

an expansion machine to be lubricated with the lubricant;

a condenser apparatus having a condenser; and means for supplying lubricant from the lubricant separator to the condenser apparatus and/or to the evaporator when the cycle device is shut down, so that a working medium enriched with the lubricant can be provided in the condenser apparatus and/or in the evaporator, the means for supplying lubricant from the lubricant separator comprising a connection conduit connecting a steam-side outlet of the lubricant separator and the condenser apparatus and/or the evaporator, the conduit including a valve configured to provide a rapid reduction of pressure in the lubricant separator resulting in evaporation of the working substance dissolved in the lubricant and a frothing up of the lubricant, thereby moving lubricant from the lubricant separator to the condenser apparatus and/or the evaporator.

12. The cycle device according to claim 11, in which the means for supplying lubricant from the lubricant separator to the condenser apparatus comprise a bypass line provided with a first valve between the lubricant separator and the condenser apparatus for bypassing the expansion machine and/or the means for supplying lubricant from the lubricant separator to the evaporator comprise a lubricant conduit between the evaporator and the lubricant separator.

13. The cycle device according to claim 11, in which the condenser apparatus further comprises a feed container in which condensed working substance and lubricant from the lubricant separator can be collected, and wherein the cycle device further comprises a feed pump for pumping working medium enriched with the lubricant from the feed container to the evaporator.

14. The cycle device according to claim 11, in which means for detecting a filling level of lubricant in the lubricant separator are provided.

15. The cycle device according to claim 11, in which a lubricant conduit comprising a second valve is provided between the lubricant separator and the expansion machine, wherein the lubricant separated in the lubricant separator can be conducted in the lubricant conduit to lubricating points of the expansion machine.

16. The cycle device according to claim 11, in which the cycle device is an Organic Rankine Cycle device and/or in which the expansion machine is selected from the group consisting of a piston expansion machine, screw expansion machine, a scroll expander, a vane-type machine and a Roots expander.

17. The cycle device according to claim 12, wherein the first valve is a solenoid valve.

18. The cycle device according to claim 15, wherein the second valve is a solenoid valve.

19. The cycle device according to claim 15, wherein the lubricant separated in the lubricant separator can be conducted in the lubricant conduit to a bearing of the expansion machine.

20. Steam power plant comprising the device according to claim 11.

* * * * *